US007252281B1

(12) United States Patent
Sie

(10) Patent No.: US 7,252,281 B1
(45) Date of Patent: Aug. 7, 2007

(54) APPARATUS FOR MAKING A FORMWORK FOR MOLDING CONCRETE WALLS

(76) Inventor: Yi-An Sie, No. 8, Alley 26, Lane 53, Huiming St., Yuanlin Town, Changhua County (TW)

( * ) Notice: Subject to any disclaimer, the term of this patent is extended or adjusted under 35 U.S.C. 154(b) by 0 days.

(21) Appl. No.: 11/429,992

(22) Filed: May 9, 2006

(51) Int. Cl.
*E04G 9/00* (2006.01)
*B28B 7/02* (2006.01)

(52) U.S. Cl. ..... 249/91; 249/117; 249/158; 249/219.1

(58) Field of Classification Search ..... 249/140, 249/155, 158, 159, 161, 217, 13, 21, 219.1, 249/117, 163; 425/253–256
See application file for complete search history.

(56) References Cited

U.S. PATENT DOCUMENTS 950,724 A * 3/1910 Dogal ..... 249/144
961,659 A * 6/1910 Taylor ..... 249/85
1,007,623 A * 10/1911 Zwicker ..... 249/149
1,468,702 A * 9/1923 Dunn ..... 249/129
1,531,366 A * 3/1925 Zottoli ..... 264/157
1,534,409 A * 4/1925 Perrault ..... 249/112
1,645,776 A * 10/1927 Sanson ..... 249/104
1,705,354 A * 3/1929 Berry ..... 249/140
1,958,184 A * 5/1934 Cross ..... 425/89
1,984,087 A * 12/1934 Scheel ..... 249/14
2,629,135 A * 2/1953 Johnson ..... 264/426
3,443,786 A * 5/1969 Bachner ..... 249/68
3,572,625 A * 3/1971 Williamsen ..... 249/117
3,643,911 A * 2/1972 Reid ..... 249/170
3,856,257 A * 12/1974 Wetstone ..... 249/160
5,535,981 A * 7/1996 Goris ..... 249/157
5,536,160 A * 7/1996 Wallace ..... 425/414

* cited by examiner

*Primary Examiner*—James P. Mackey
*Assistant Examiner*—Dimple Bodawala
(74) *Attorney, Agent, or Firm*—Rosenberg, Klein & Lee

(57) ABSTRACT

A formwork making apparatus includes a bottom block, two side locating boards arranged in parallel on the bottom block, two forming boards respectively adhered to the side locating boards and set facing each other, two blocking plates set between the two side locating boards at the two distal ends and defining with the side locating boards and the bottom block an elongated molding chamber, and two fixtures fastened to the side locating boards and the blocking plates to secure the side locating boards and the blocking plates to the bottom block.

4 Claims, 6 Drawing Sheets

APPARATUS FOR MAKING A FORMWORK FOR MOLDING CONCRETE WALLS

BACKGROUND OF THE INVENTION

1. Field of the Invention

The present invention relates to concrete construction and more particularly, to an apparatus for making formworks for molding concrete walls.

2. Description of the Related Art

When making a number of same quality products, a mold shall be used. Similarly, formworks are needed when making concrete walls of same quality. The design of a mold has a direct concern with the quality of the finished product. When making a concrete wall according to a conventional technique, L-shaped form boards are vertically set together, and then concrete is filled into the molding chamber surrounded by the L-shaped form boards. This conventional technique takes much time and labor to finish a concrete wall. During molding, concrete may leak out of the gap between the form boards, or the form boards may be forced to deform. These conditions may directly or indirectly affect the quality of the finished concrete wall, and will also increase the cost.

Therefore, it is desirable to provide a formwork making apparatus, which eliminates the aforesaid problems.

SUMMARY OF THE INVENTION

The present invention has been accomplished under the circumstances in view. It is the main object of the present invention to provide a formwork making apparatus, which keeps the formwork manufacturing error within 1%. It is another object of the present invention to provide a formwork making apparatus, which saves much formwork manufacturing cost. It is still another object of the present invention to provide a formwork making apparatus, which shortens formwork manufacturing speed.

To achieve these and other objects of the present invention, the formwork making apparatus comprises a bottom block; two side locating boards arranged in parallel on a top side is of the bottom block; two forming boards respectively adhered to the side locating boards and set facing each other, the forming boards each having an outer wall respectively adhered to the side locating boards, an inner wall opposite to the inner wall, and an embossed design on the inner wall; two blocking plates set between the two side locating boards at the two distal ends, the blocking plates defining with the side locating boards and the bottom block an elongated molding chamber; and two fixtures adapted to secure the side locating boards and the blocking plates to the bottom block, the fixtures each comprising two U-frames respectively clamped on the two side locating boards, and a plurality of lock screws respectively threaded into respective mounting holes at the side locating boards and the blocking plates.

DETAILED DESCRIPTION OF THE PREFERRED EMBODIMENT

Figure 1:
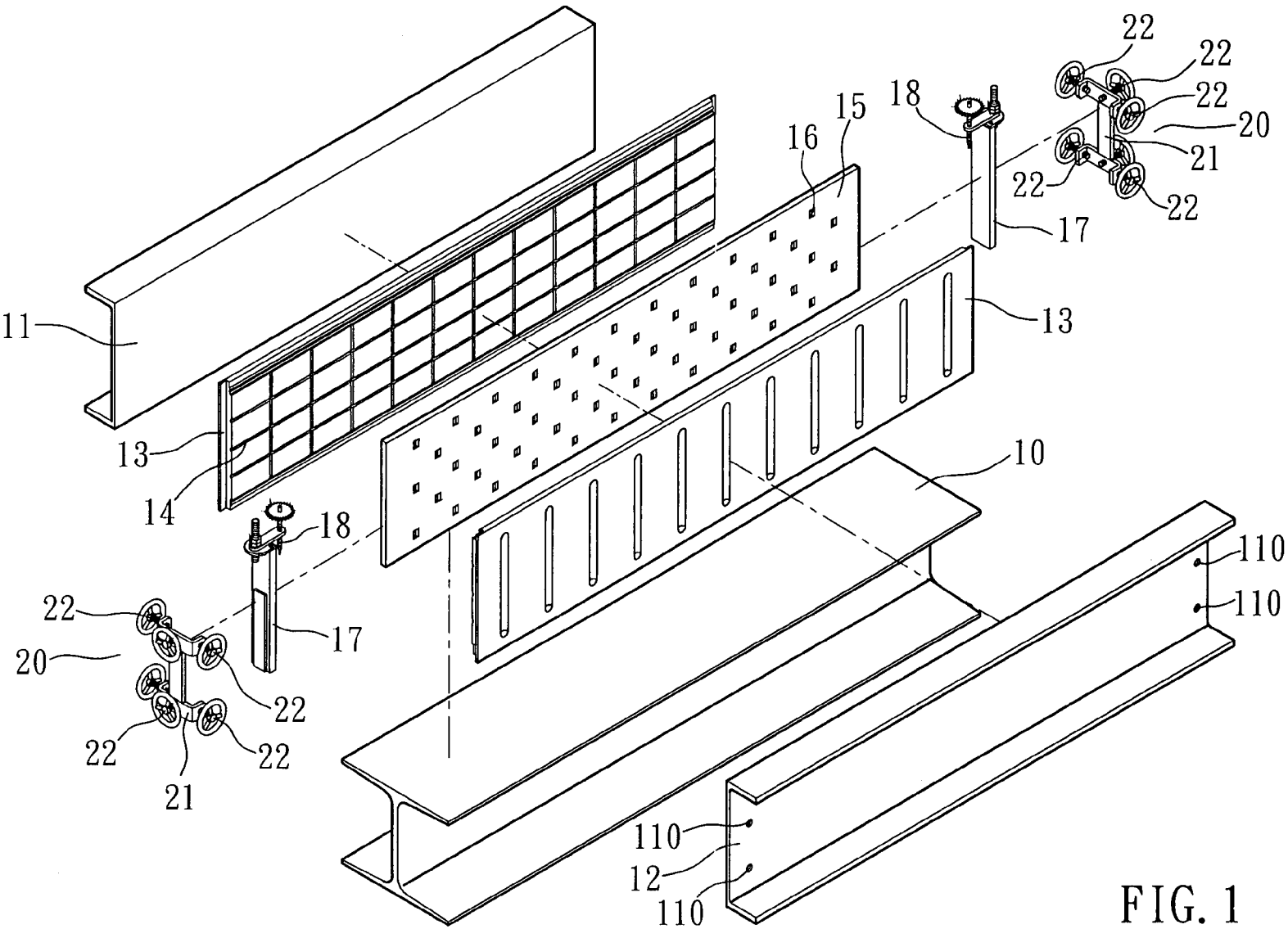
FIG. 1 is an exploded view of a formwork making apparatus according to the present invention.

Referring to FIGS. 1~7, a formwork making machine in accordance with the present invention is shown comprised of a bottom block 10, two side locating boards 11 and 12, two forming boards 13, two blocking plates 17, and two fixtures 20.

The two side locating boards 11 and 12 are arranged in parallel on the top side of the bottom block 10.

The two forming boards 13 are respectively adhered to the side locating boards 11 and 12 by a glue 130 and set facing each other, each having an embossed design 14 on the inner wall.

The two blocking plates 17 are set between the two side locating boards 11 and 12 at the two distal ends, defining with the side locating boards 11 and 12 and the bottom block 10 an elongated molding chamber.

The fixtures 20 are adapted to secure the side locating boards 11 and 12 and the blocking plates 17 to the bottom block 10, each comprising two U-frames 21 respectively clamped on the two side locating boards 11 and 12, and a plurality of lock screws 22 respectively threaded into respective mounting holes 110 at the side locating boards 11 and 12 and the blocking plates 17.

According to the present invention, the side locating boards 11 and 12 are respectively made of an iron plate. The forming boards 13 and the blocking plates 17 are molded from plastics.

Figure 2:
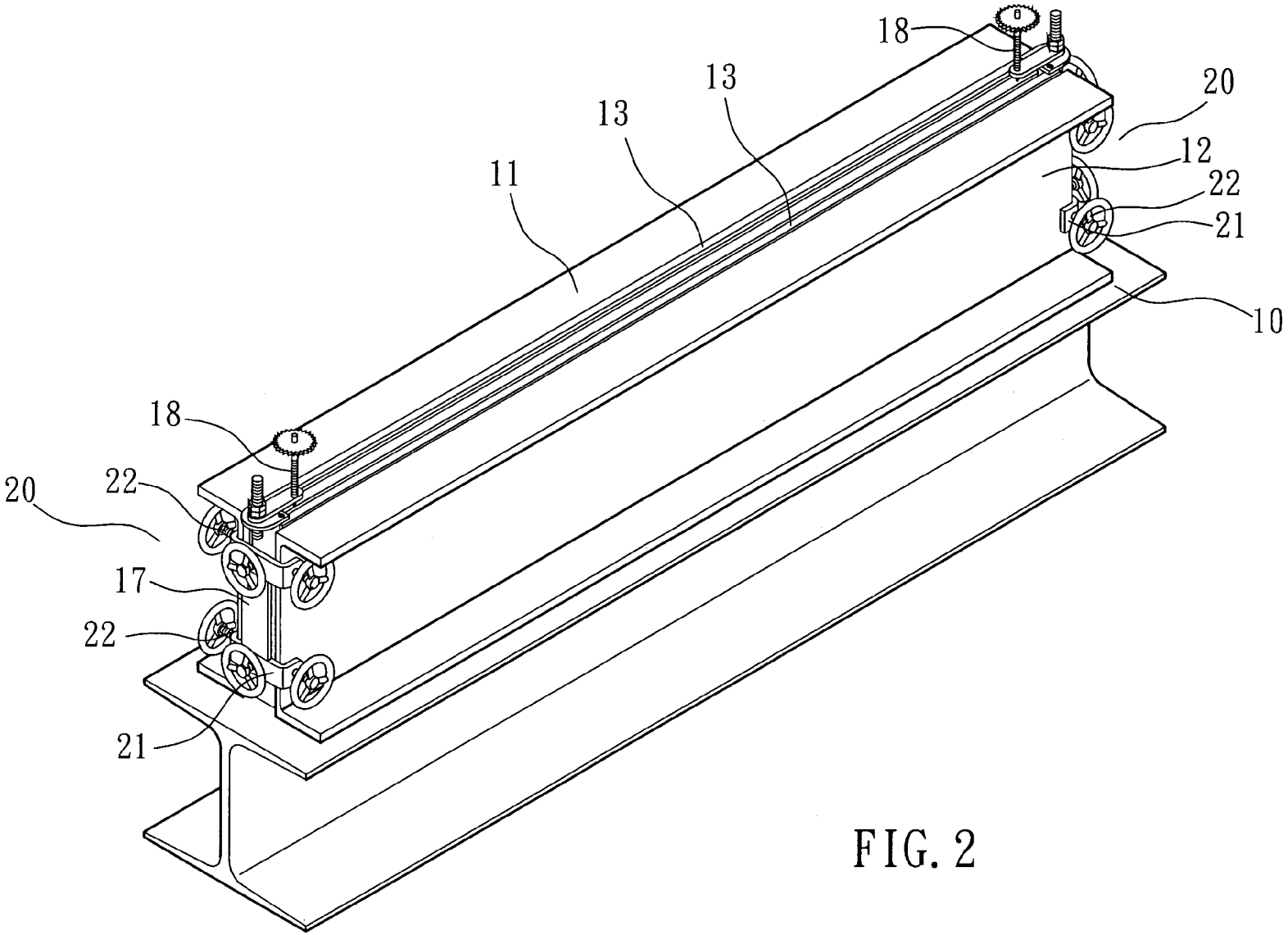
FIG. 2 is an elevational assembly view of the formwork making apparatus according to the present invention.
Figure 4:
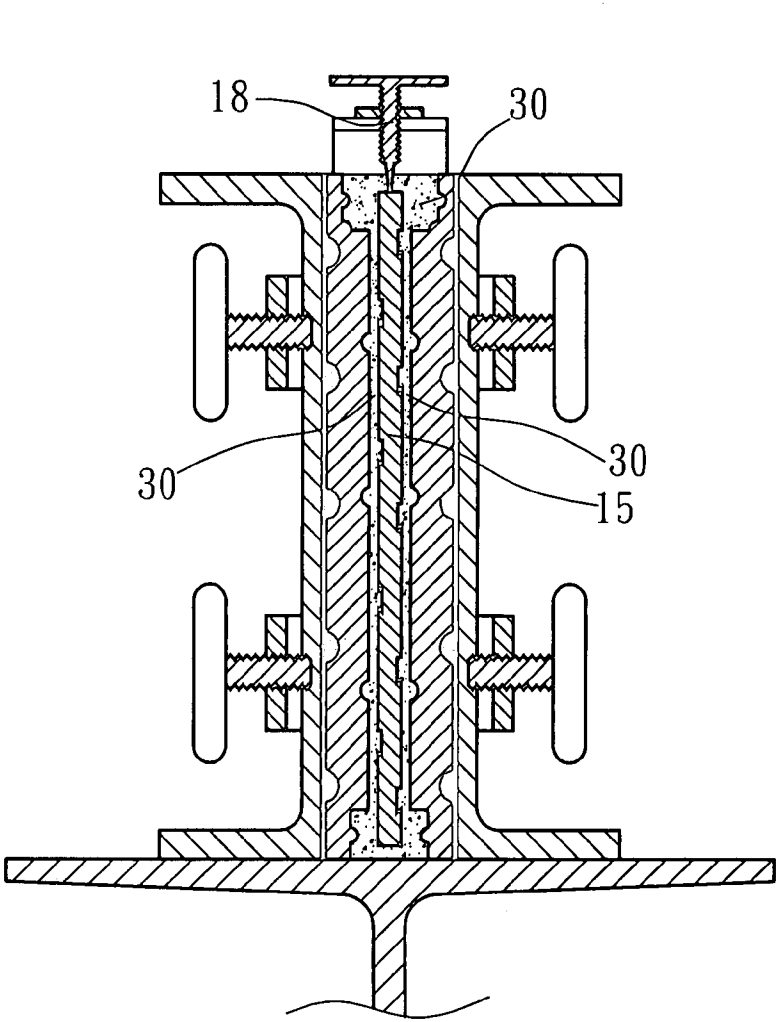
FIG. 4 corresponds to FIG. 3, showing a wooden board embedded in the fluid plastic material in the molding chamber of the formwork making apparatus.
Figure 3:
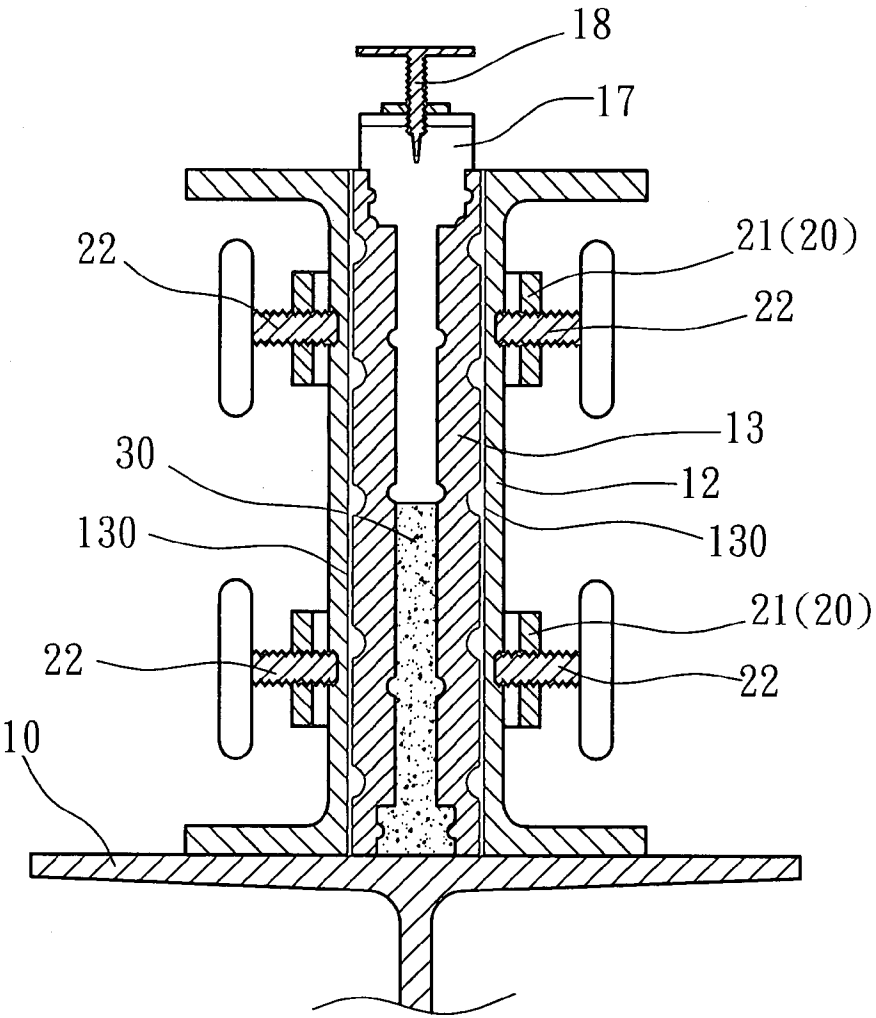
FIG. 3 is an applied view in section of the present invention, showing a fluid plastic material filled in the molding chamber of the formwork making apparatus.
Figure 5:
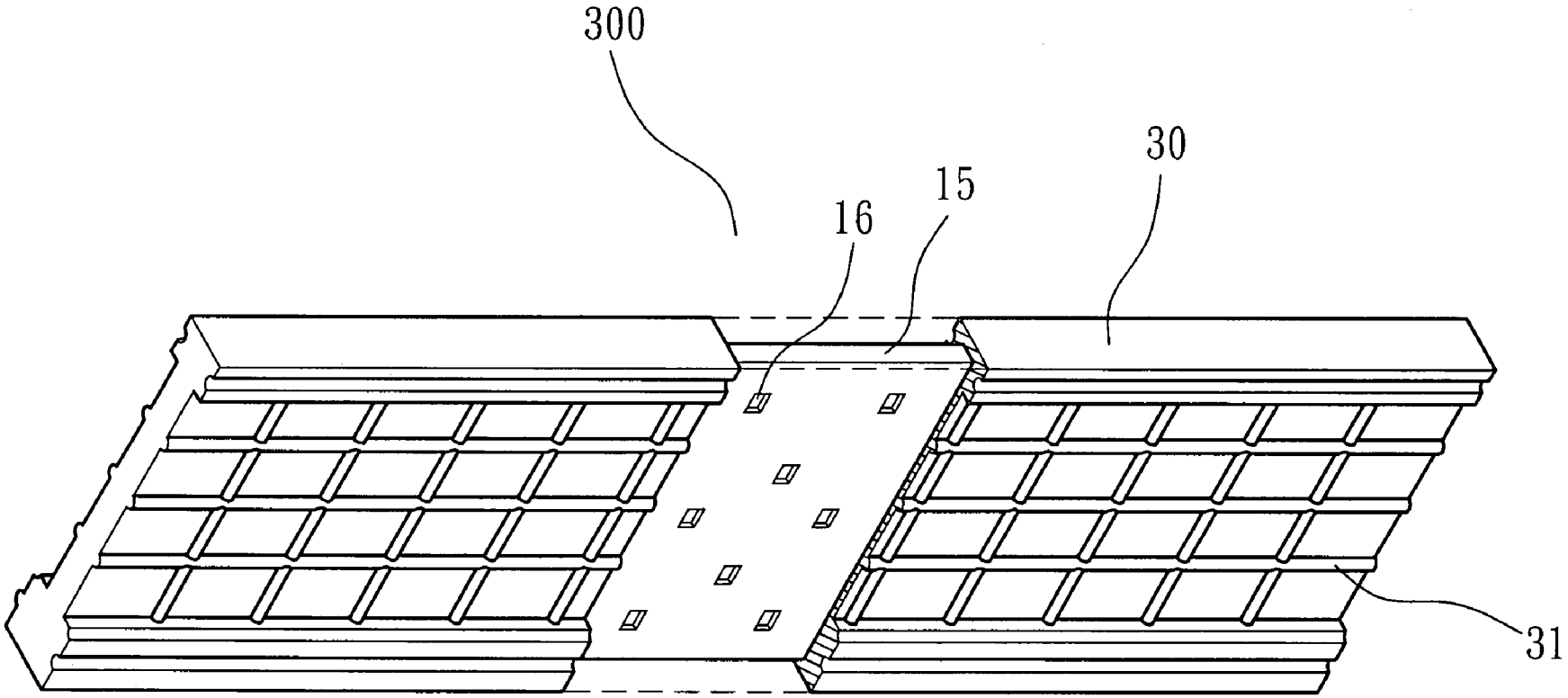
FIG. 5 is a cutaway view of a formwork made according to the present invention.
Figure 6:
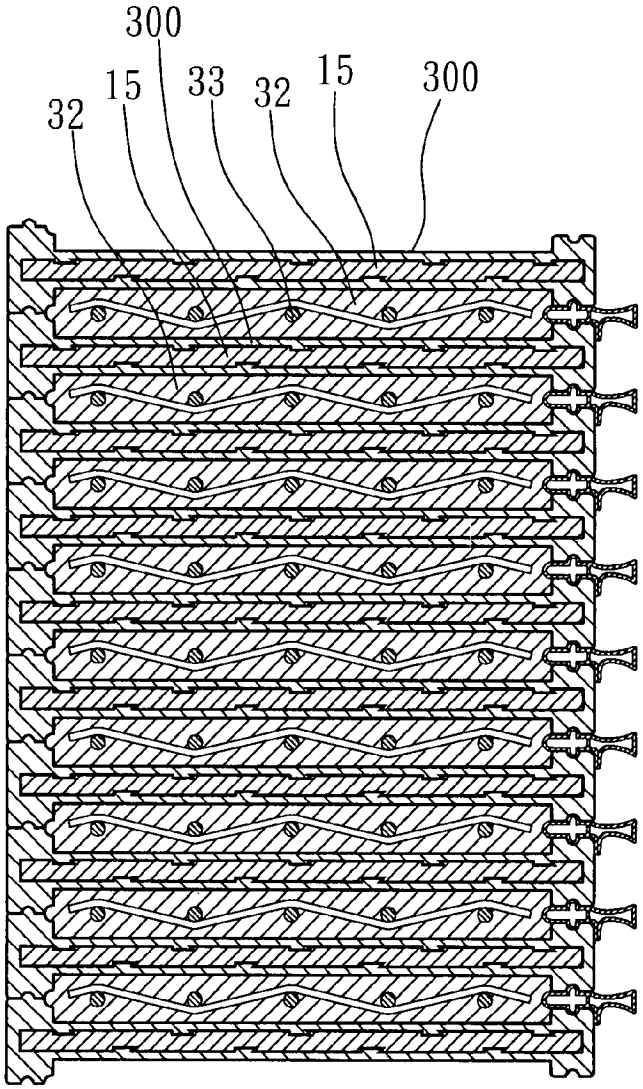
FIG. 6 is a schematic sectional view showing multiple formwork making apparatus arranged together.
Figure 7:
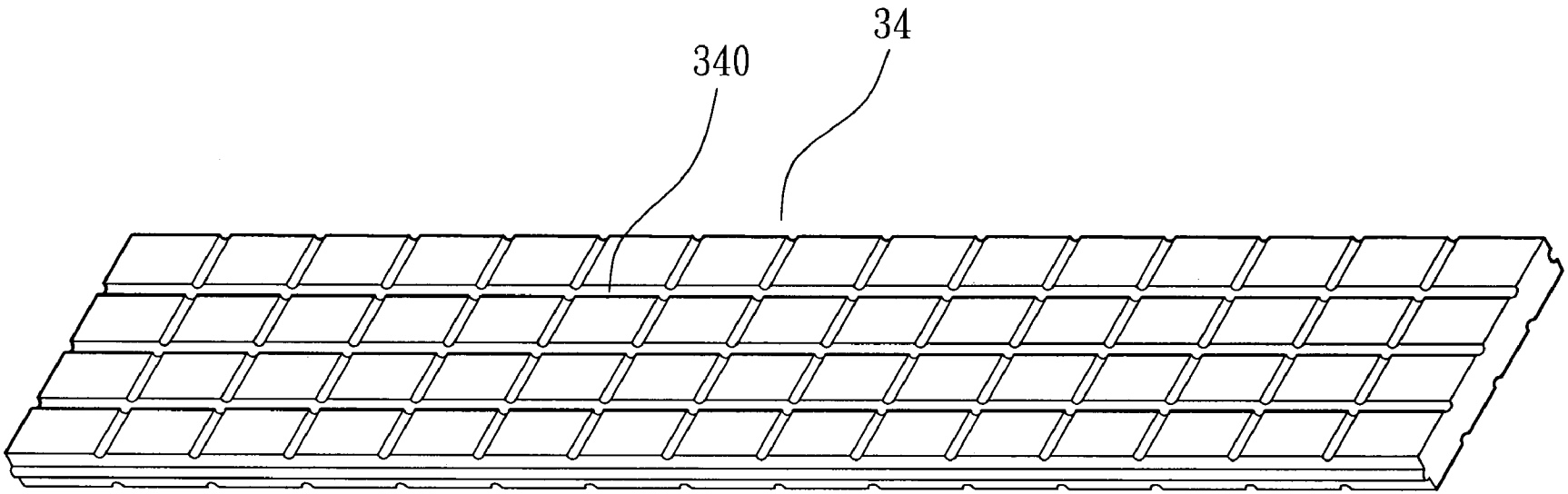
FIG. 7 is an elevational view of a concrete wall made according to the present invention.

When making a concrete wall molding formwork 300 (see FIG. 5), as shown in FIGS. 2 and 3, the side locating boards 11 and 12 with the forming boards 13 and the blocking plates 17 are arranged on the bottom block 10 and fixed in place with the fixtures 20, and then a prepared fluid plastic material 30 is filled into the elongated molding chamber surrounded by the blocking plates 17 and the side locating boards 11 and 12 to the half volume of the elongated molding chamber as shown in FIG. 3, and then a wooden board 15 is inserted into the fluid plastic material 30 between the forming boards 13, and then the prepared fluid plastic material 30 is filled into the elongated molding chamber to the full level, keeping the wooden board 15 embedded in the fluid plastic material 30 as shown in FIG. 4. After setting of the fluid plastic material 30, the desired formwork 300 having a design 31 on the surface is thus obtained as shown in FIG. 5.

Referring to FIG. 5 again, the formwork 300 has the wooden board 15 embedded therein. The use of the wooden board 15 saves much plastic material and reinforces the structural strength of the formwork 300. Further, the wooden board 15 has a plurality of through holes 16 for the bonding of the plastic material 30.

Further, the two blocking plates 17 each have a top screw rod 18 vertically disposed at the top for stopping the wooden board 15 in the fluid plastic material 30 during molding (see FIG. 4).

When making concrete walls 34 (see FIG. 7), multiple formworks 300 are arranged together with an iron mesh 33 set in between each two adjacent formworks 300, and then concrete 32 is filled in the gap between each two adjacent formworks 300. After setting, of the concrete 32, the formworks 300 are stripped off, and multiple concrete walls 34 having a design 340 are thus obtained.

As indicated above, the invention has the following advantages:

(1) By means of the bottom block 10, the side locating boards 11 and 12, the forming boards 13, the blocking plates 17 and the fixtures 20, formworks 300 are made rapidly at a low cost.

(2) Formworks 300 are made in a flat shape and can be arranged in a stack to reduce space occupation when not in use.

(3) Multiple formworks 300 can be arranged together to make multiple concrete walls 34 at a time, thereby saving concrete wall manufacturing time and lowering the manufacturing cost of concrete walls 34.

(4) Because each formwork 300 is molded from plastics with a wooden board 15 embedded therein, each formwork 300 has a high structural strength but a light weight convenient for delivery.

(5) Because each formwork 300 is molded from plastics, it is resistive against concrete.

Although a particular embodiment of the invention has been described in detail for purposes of illustration, various modifications and enhancements may be made without departing from the spirit and scope of the invention.

What the invention claimed is:

1. A formwork making apparatus comprising:

a bottom block;

two side locating boards arranged in parallel on a top side of said bottom block;

two forming boards respectively adhered to said side locating boards and set facing each other, said forming boards each having an outer wall respectively adhered to said side locating boards, an inner wall opposite to said outer wall, and an embossed design on said inner wall;

two blocking plates set between said two side locating boards at the two distal ends, said blocking plates defining with said side locating boards and said bottom block an elongated molding chamber;

two fixtures adapted to secure said side locating boards and said blocking plates to said bottom block, said fixtures each comprising two U-frames respectively clamped on said two side locating boards, and a plurality of lock screws respectively threaded into respective mounting holes at said side locating boards and said blocking plates; and, a board member disposed within said elongated molding chamber for embedding within a mold material introduced therein.

2. The formwork making apparatus as recited in claim 1, further comprising an adjustable stopping member coupled to one said blocking plate, said stopping member being displaceable to releasably capture said board member within said elongated molding chamber.

3. The formwork making apparatus as recited in claim 2, wherein said adjustable stopping member includes a top screw rod coupled in displaceable manner relative to said blocking plate.

4. The formwork making apparatus as recited in claim 1, wherein said board member is formed with a plurality of through holes for passage of mold material therethrough.

* * * * *